US011253746B2

(12) United States Patent
Mains et al.

(10) Patent No.: US 11,253,746 B2
(45) Date of Patent: Feb. 22, 2022

(54) EXERCISE BAR AND GRIP HANDLE

(71) Applicant: Stick Mobility Products LLC, Los Gatos, CA (US)

(72) Inventors: Jeff Mains, Los Gatos, CA (US); Randy Hew, San Jose, CA (US); Mike Schroder, White Salmon, WA (US); Frank Gray, Medford, OR (US)

(73) Assignee: STICK MOBILITY PRODUCTS LLC, Los Gatos, CA (US)

( * ) Notice: Subject to any disclaimer, the term of this patent is extended or adjusted under 35 U.S.C. 154(b) by 0 days.

(21) Appl. No.: 16/501,112

(22) Filed: Jun. 25, 2018

(65) Prior Publication Data

US 2019/0388726 A1 Dec. 26, 2019

(51) Int. Cl.
*A63B 23/16* (2006.01)
*A63B 23/00* (2006.01)

(52) U.S. Cl.
CPC ..... *A63B 23/16* (2013.01); *A63B 2023/006* (2013.01)

(58) Field of Classification Search
CPC ... A63B 23/16; A63B 2023/006; A63B 60/20; A63B 53/14
See application file for complete search history.

(56) References Cited

U.S. PATENT DOCUMENTS 5,788,608 A * 8/1998 Wilkinson ..... A63B 21/0724 482/51
5,868,651 A * 2/1999 Washington ..... A63B 21/00043 482/122
D407,770 S * 4/1999 Thomas ..... D21/679
6,293,893 B1 * 9/2001 Truchelut ..... A63B 21/002 482/121
7,285,079 B2 * 10/2007 Mandell ..... A63B 21/00043 482/126
7,314,438 B1 * 1/2008 Clark ..... A63B 21/0455 482/107
7,641,566 B2 * 1/2010 O'Connor ..... A63B 21/0004 473/219
7,850,582 B2 * 12/2010 Smith ..... A63B 21/00043 482/121
9,675,837 B2 * 6/2017 Smith ..... A63B 21/4035
D853,505 S * 7/2019 Toueg ..... D21/679
2004/0185990 A1 * 9/2004 Orescan ..... A63B 21/0552 482/126
2004/0242387 A1 * 12/2004 Benach ..... A63B 21/00043 482/126
2005/0096159 A1 * 5/2005 Houston ..... A63B 69/0024 473/513

(Continued)

*Primary Examiner* — Joshua Lee
(74) *Attorney, Agent, or Firm* — Haley Guiliano LLP

(57) ABSTRACT

Handle grip are configured to interface to the end of a bar allowing a user to employ the bar for motion, exercise, stretching or other activity. For example, the handle grips may slip onto the bar under force. The handle grips include a grip section, configured to provide a surface the user can grab. Accordingly, the grip surface may include features that increase the effective friction coefficient. The handle grip also includes an end section configured to react both axial and lateral loads applied by the user via the grip section. The bar can be sectioned, making storage and transport easier. Accordingly, the sectioned bar can be assembly to provide the desired length of exercise bar.

21 Claims, 16 Drawing Sheets

(56) References Cited

U.S. PATENT DOCUMENTS

| | | | | |
|---|---|---|---|---|
| 2005/0113223 | A1* | 5/2005 | Dovner | A63B 21/0004 482/121 |
| 2010/0009822 | A1* | 1/2010 | Holleman | A63B 21/0004 482/126 |
| 2010/0240505 | A1* | 9/2010 | Yang | A63B 21/0004 482/126 |
| 2013/0029811 | A1* | 1/2013 | Lando | A63B 21/023 482/121 |
| 2013/0296145 | A1* | 11/2013 | Tomaszewski | A63B 21/06 482/106 |
| 2018/0104539 | A1* | 4/2018 | Carpinelli | A63B 21/026 |

* cited by examiner

EXERCISE BAR AND GRIP HANDLE

BACKGROUND

In order to perform some exercises, such as stretches, for example, an exercise bar may be used. The exercise bar may allow a user to use their reach to stretch one or more muscle groups.

FIG. 1 shows a perspective view of an illustrative end of an exercise bar 100. The end of exercise bar 100 includes two separate parts: end cap 102 and grip 104. End cap 102 is applied to exercise bar 100 to provide a reaction surface for exercises. End cap 102 is made of a relatively hard material that is able to react axial loads, without becoming damaged or damaging a corresponding surface (e.g., the floor). Grip 104 is applied to exercise bar 100 to provide a gripping surface for a user. Grip 104 includes a relatively soft spiral wrap that is applied to the bar near to end cap 102. The spiral wrap is similar to a tennis racquet wrap. Tape 108 is wrapped around each axial end of grip 104 to aid in holding grip 104 in place. Specifically, tape 108 helps secure each end of the spiral wrap to the bar.

While end cap 102 and grip 104 are configured to provide different functions at the end of an exercise bar, there are several issues with this configuration. For example, grip 104 may be susceptible to deformation, sliding, or other movement which could damage exercise bar 100 and cause an injury to the user. Further, grip 104 may be unable to transmit signification forces (e.g. all or some of user's body weight) without shifting. In addition, end cap 102 does not extend along exercise bar 100 and may be limited in the amount of lateral force (e.g., against the ground) that can applied without slipping or causing material damage, both of which could lead to injury. Further, grip 104 and end cap 102 are separate parts, and accordingly are applied separately. Grip 104 and end cap 102 are not configured to transmit force directly between each other, nor provide any stiffness together as a unit.

It would be advantageous for an exercise bar to be able to withstand significant axial loads and lateral loads. It would also be advantageous for an exercise bar to have one-piece handle grips through which a user may transmit significant force. It would also be advantageous for an exercise bar to have one-piece handle grips that perform multiple functions. It would also be advantageous for an exercise bar to be modular, and be capable of being packed for travel or storage.

SUMMARY

In some embodiments, the present disclosure is directed to a tubular handle grip configured to interface to an end of a cylindrical bar. In some embodiments, the handle grip includes a grip section at least 8 inches in axial length and having a wall thickness, an open end arranged at one end of the grip section and configured to fit over the end of the cylindrical bar, and a closed end coupled to the grip section and arranged axially opposite to the open end. The closed end is configured to react axial and lateral loads from a user.

In some embodiments, the closed end includes a thickness greater than the wall thickness.

In some embodiments, the closed end is coupled to the grip section by a transition section having a varying wall thickness.

In some embodiments, the tubular hand grip is substantially axisymmetric about a center axis.

In some embodiments, the open end is open to a cylindrical recess extending axially inside of the grip section. Further, the cylindrical recess is configured to engage with the end of the cylindrical bar.

In some embodiments, the cylindrical recess is at least 12 inches long.

In some embodiments, the cylindrical recess is configured to engage with the end of the cylindrical bar by a friction force.

In some embodiments, the grip section is in tension azimuthally, and the tension causes the friction force.

In some embodiments, the grip section includes an outer surface. The outer surface includes a plurality of raised features configured to increase the effective friction between the outer surface and the user.

In some embodiments, the grip section comprises an outer diameter of at least 1.5 inches.

In some embodiments, the tubular handle grip is at least 12 inches long.

In some embodiments, the closed end has a maximum diameter of at least 2 inches.

In some embodiments, the present disclosure is directed to a fitness system. The fitness system includes a bar having two ends, and a pair of handle grips, each arranged at a respective end of the bar. Each handle grip includes a grip section, an open end, and a closed end. The grip section is at least 8 inches in axial length and has a wall thickness. The open end is arranged at one end of the grip section and is configured to slide over a respective end of the bar. The closed end is coupled to the grip section and arranged axially opposite to the open end. Further, the closed end is configured to react axial and lateral loads from a user.

In some embodiments, the bar includes at least two segments configured to engage axially to form the bar comprising the two ends. In some embodiments, each segment engages with another segment at a respective interface. In some embodiments, the fitness system further includes a respective coupler that is arranged at each respective interface and that is configured to aid in engaging the corresponding segments.

In some embodiments, the fitness system includes a respective locking mechanism corresponding to each respective interface. The locking mechanism is configured to constrain a relative motion of the corresponding segments.

In some embodiments, the present disclosure is directed to a fitness system having a segmented bar. The fitness system includes a bar and a pair of handle grips. The bar includes at least two segments configured to engage axially to form the bar, and the bar has two ends. The pair of handle grips are arranged at each end of the bar and are configured to react axial and lateral loads from a user.

In some embodiments, each segment engages with another segment at a respective interface. In some embodiments, the fitness system includes a respective coupler that is arranged at each respective interface and that is configured to aid in engaging the corresponding segments.

In some embodiments, the fitness system includes a respective locking mechanism corresponding to each respective interface. The locking mechanism is configured to constrain a relative motion of the corresponding segments.

In some embodiments, each segment has a length of two feet or less.

BRIEF DESCRIPTION OF THE DRAWINGS

The present disclosure, in accordance with one or more various embodiments, is described in detail with reference to the following figures. The drawings are provided for purposes of illustration only and merely depict typical or example embodiments. These drawings are provided to facilitate an understanding of the concepts disclosed herein and shall not be considered limiting of the breadth, scope, or applicability of these concepts. It should be noted that for clarity and ease of illustration these drawings are not necessarily made to scale.

DETAILED DESCRIPTION

The present disclosure is directed to exercise bars and components thereof. In some embodiments, the present disclosure is directed to handle grips which can be installed at each end of an exercise bar. In some embodiments, the present disclosure is directed to an exercise bar having handle grips. In some embodiments, the present disclosure is directed to a segmented exercise bar, which may be equipped with handle grips.

A long, suitably pliant bar may be used to aid in physical activity. For example, a user may use such a bar to improve leverage, stability, muscle irradiation, isometric stimulation, kinetic feedback, coordination, flexibility, or a combination thereof. By applying a force on a grip on the bar, and experiencing resistance from the reactive force of the bar, the user's muscles are engaged. For example, the force may be applied axially (e.g., putting the bar in compression) to stretch a muscle group. In a further example, the force may be applied off axis (e.g., applying a bending moment and shear force to the bar) to stretch a muscle group. In some embodiments, the axial ends of the bar, which are equipped with handle grips, are configured to accommodate such force loads, while providing sufficient friction with a surface to prevent slippage.

Figure 1:
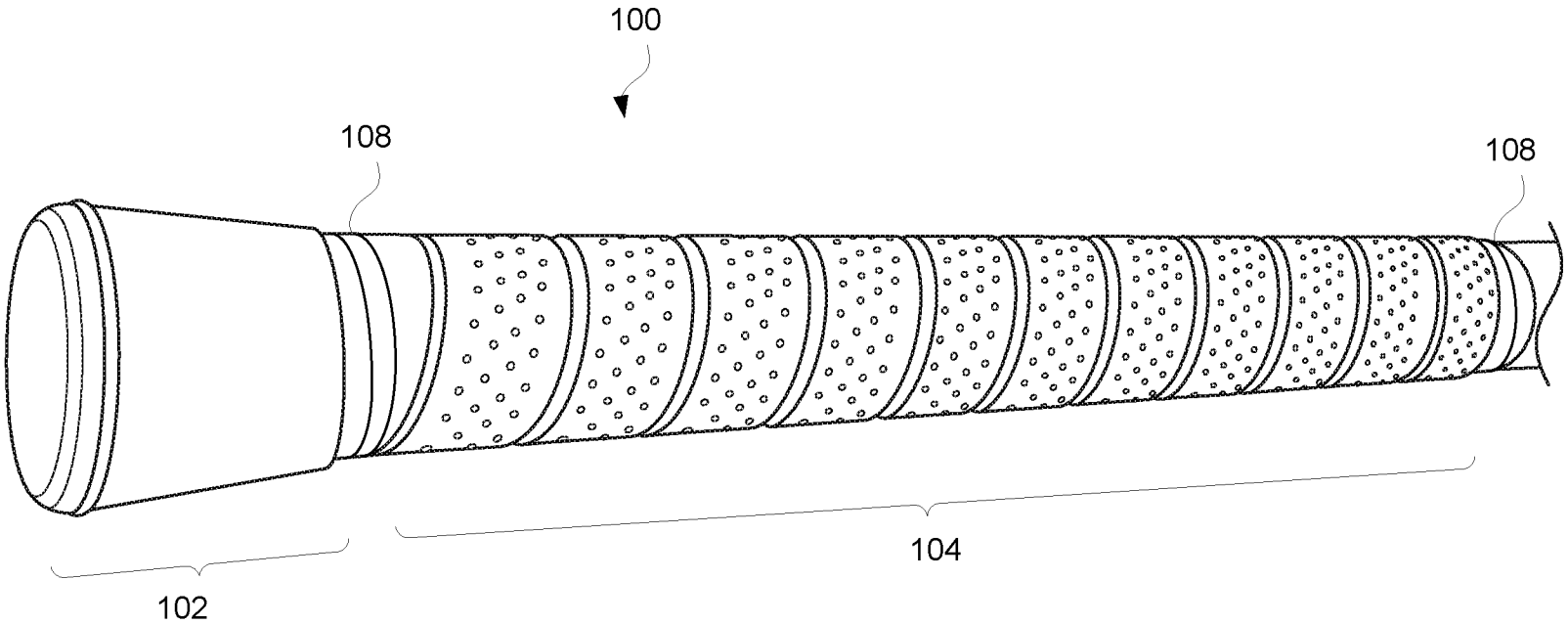
FIG. 1 (Prior Art)
FIG. 1 shows a perspective view of an illustrative end of a prior art exercise bar.
Figure 2:
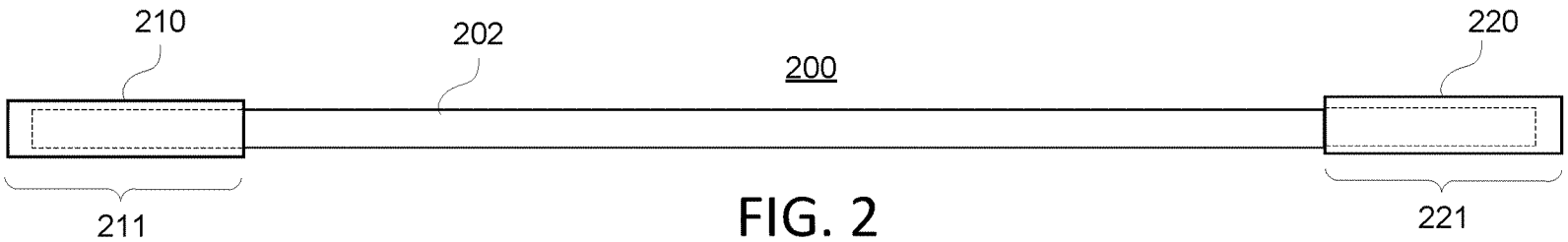
FIG. 2 shows a side view of an illustrative exercise bar, having two handle grips, in accordance with some embodiments of the present disclosure.
Figure 3:
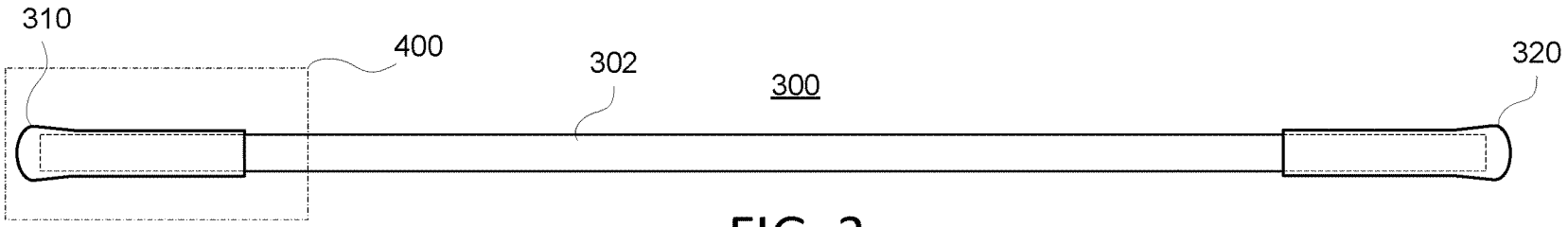
FIG. 3 shows a side view of an illustrative exercise bar, having two handle grips, in accordance with some embodiments of the present disclosure.
Figure 4:
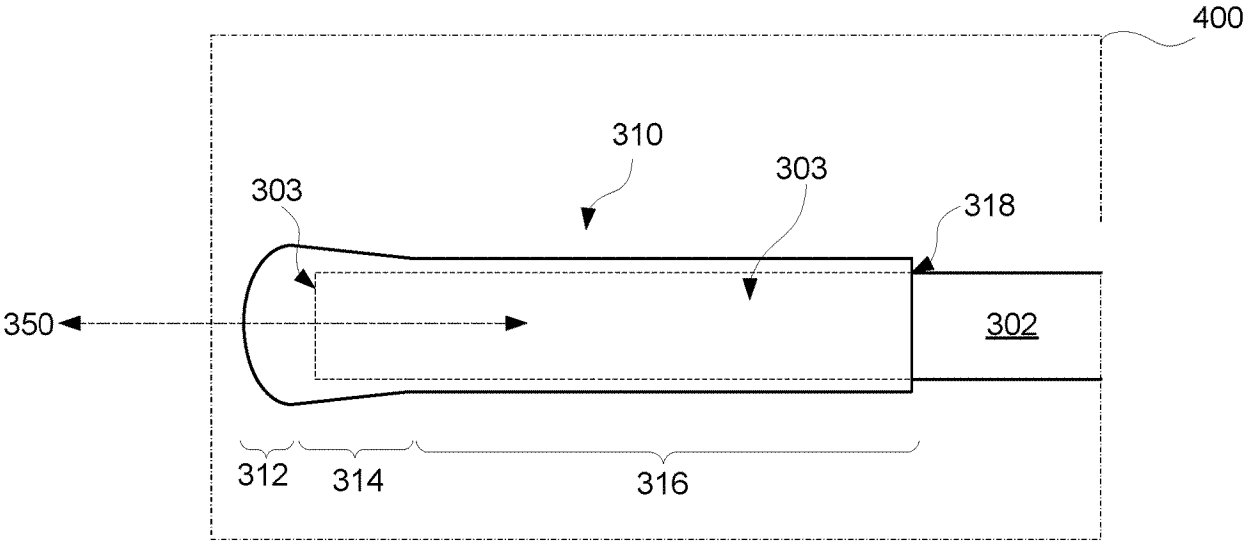
FIG. 4 shows an enlarged view of the end of illustrative exercise bar of FIG. 3, in accordance with some embodiments of the present disclosure.

In some embodiments, a handle grip may be configured to be applied to a bar to form an exercise bar. FIGS. 2-4 show illustrative exercise bars, in accordance with some embodiments of the present disclosure. The illustrative, one-piece handle grips of the present disclosure may be formed from a single material, which has the same material properties throughout the grips. Using a single material for the handle grips causes difficulty when the handle grips are used for multiple functions (e.g., resisting axial and lateral loads at the end and providing a sufficient gripping surface for the user). In some embodiments, the disclosed handle grips are shaped to allow a single material to provide sufficient rigidity for the end section (e.g., to react forces), sufficient friction properties at the end section (e.g., to prevent slippage of the exercise bar), desired stiffness of a grip section (e.g., to improve hand-feel), and desired friction properties of the grip section to prevent hand slippage.

FIG. 2 shows a side view of illustrative exercise bar 200, having handle grips 210 and 220, in accordance with some embodiments of the present disclosure. As shown in FIG. 2, handle grips 210 and 220 are arranged at opposite ends of bar 202. For example, handle grips 210 and 220 may be slid onto, adhered onto, or otherwise firmly attached to bar 202 to transmit significant forces from a user. In some embodiments, handle grips 210 and 220 include a grip section having a sufficient length to accommodate one or both of a user's hands in a gripping configuration. For example, in some embodiments, the lengths 211 and 221 of respective handle grips 210 and 220 are each eight inches or more. In some embodiments, bar 202 is configured to be stiff enough to withstand a user's body weight, or significant portion thereof, while still being pliant enough to provide a sufficient spring force to aid in exercising.

FIG. 3 shows a side view of illustrative exercise bar 300, having handle grips 310 and 320, in accordance with some embodiments of the present disclosure. Handle grips 310 and 320, as illustratively shown in FIG. 3, exhibit further contouring as compared to handle grips 210 and 220 of FIG. 2, in accordance with some embodiments of the present disclosure. As shown in FIG. 3, handle grips 310 and 320 are arranged at opposite ends of bar 302. For example, handle grips 310 and 320 may be slid onto, adhered onto, or otherwise firmly attached to bar 302 to transmit significant forces from a user. In some embodiments, handle grips 310 and 320 include a grip section having a sufficient length to accommodate one or both of a user's hands in a gripping configuration. In some embodiments, bar 302 is configured to be stiff enough to withstand a user's body weight, or a significant portion thereof, while still being pliant enough to provide a sufficient spring force to aid in exercising. Region 400 indicates the extent of the enlarged view of exercise bar 300 shown in FIG. 4.

FIG. 4 shows an enlarged view of the end of illustrative exercise bar 300 of FIG. 3, in accordance with some embodiments of the present disclosure. Axis 350 denotes the center axis of exercise bar 300. Handle grip 310 includes open end 318, closed end 312, transition section 314, and grip section 316. In some embodiments, handle grip 310 is substantially axisymmetric about axis 350.

In some embodiments, open end 318 opens to a cylindrical recess extending along axis 350 inside of grip section 316. Open end 318 is configured to, for example, accommodate insertion of bar 302. End 303 of bar 302, for example extends through open end 318 and into the cylindrical recess. In some embodiments, the cylindrical recess is configured to engage with the end portion of the cylindrical bar (e.g., along the inside of grip section 316). End 303 includes the end face of bar 302 as well as the axial length of bar 302 within (e.g., engaged with) grip section 316.

In some embodiments, closed end 312 is arranged at the axial end of bar 302. Closed end 312 is configured to react axial and lateral loads (e.g., forces) against a reference surface such as a floor, for example. In some embodiments, closed end 312 may include one or more radii of curvature, one or more curved sections, or both. In some embodiments, the maximum outer diameter of closed end 312, or a portion thereof, is larger than the outer diameter of grip section 316 and at least a portion of transition section 314. In some embodiments, closed end 312 has a material thickness greater than the wall thickness of grip section 316.

In some embodiments, transition section 314 may be optionally included as a geometric transition between grip section 316 and closed end 312. For example, grip section 316 may have a first outer diameter and closed end 312 may include a second outer diameter, and transition section 314 may couple the first and second outer diameters smoothly. In some embodiments, transition section 314 need not be included, and grip section 316 directly abuts closed end 312. In some embodiments, transition section 314 may provide a smoother radial profile of handle grip 310, may improve feel by a user, may aid in transmitting force, or a combination thereof. In some embodiments, transition section 314 includes a varying wall thickness, outer diameter, inner diameter, or a combination thereof.

In some embodiments, grip section 316 is configured to cover a section of bar 302, allowing a user to grip exercise bar 300. For example, a user may grip onto grip section 316 using hands, the inside of an elbow joint, the back of a knee, an underarm, the sole of a foot, or any other suitable portion of the user's body. The user's grip may include any suitable azimuthal engagement including a full grip (e.g., fingers wrapped completely around grip section 316), point contact (e.g., push on side of grip 316), a partial grip (e.g., grasping exercise bar 300 using a bicep and corresponding forearm in the inside of an elbow joint), or any suitable combination thereof. In some embodiments, inside grip section 316, the cylindrical recess is configured to engage with the end of the cylindrical bar by a friction force. In some such embodiments, grip section 316 is in tension azimuthally (e.g., around axis 350), and the tension causes the friction force. In some embodiments, grip section 316 includes an outer surface (e.g., the surface where a user applies their grip). The outer surface may include, for example, a plurality of raised features configured to increase the effective friction between the outer surface and the user (e.g., to improve the user's grip and hand feel).

Figure 5B:
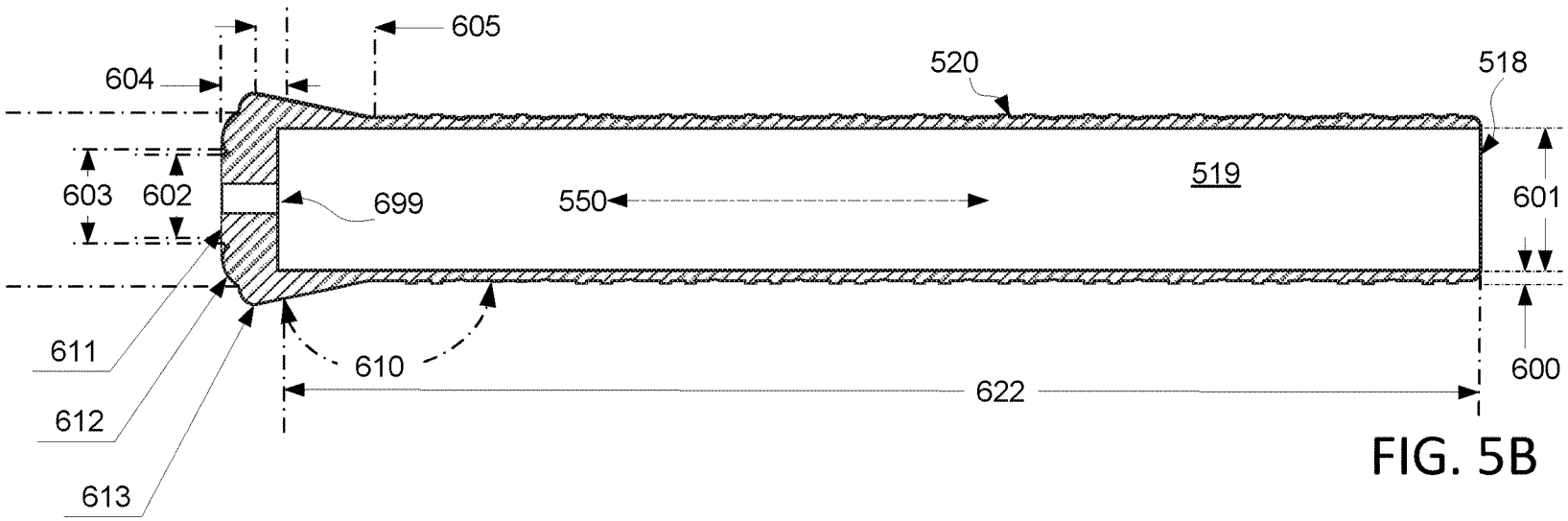
FIG. 5B shows a cross-sectional view of the illustrative handle grip of FIG. 5A, in accordance with some embodiments of the present disclosure.
Figure 5A:
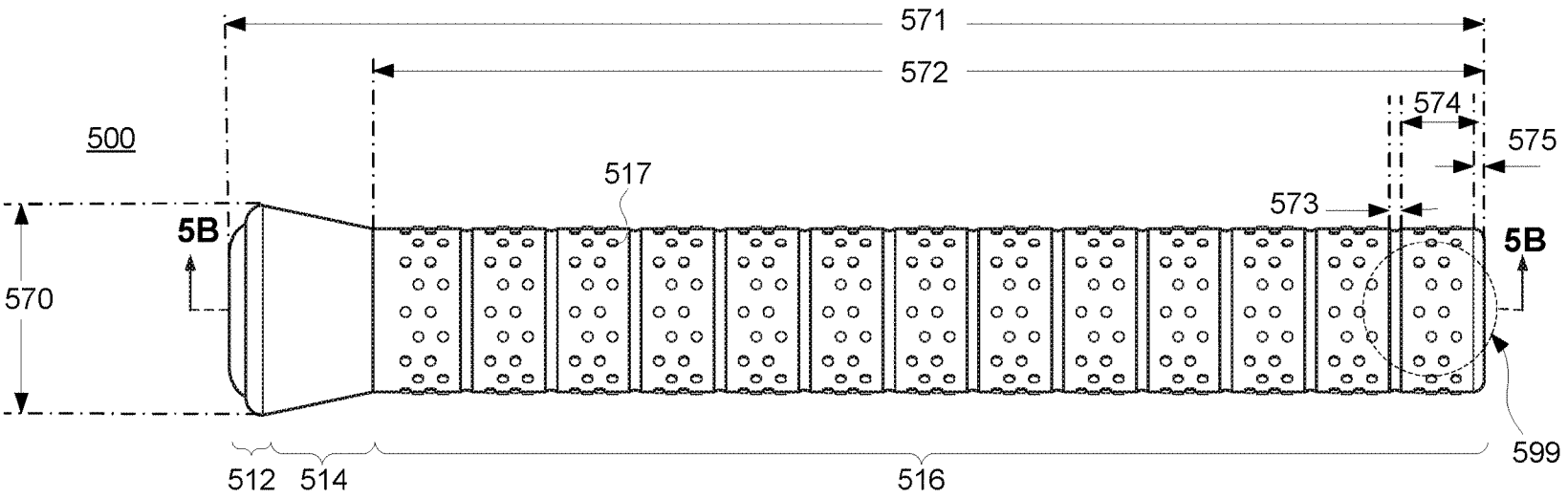
FIG. 5A shows a side view of an illustrative handle grip, in accordance with some embodiments of the present disclosure.
Figure 6:
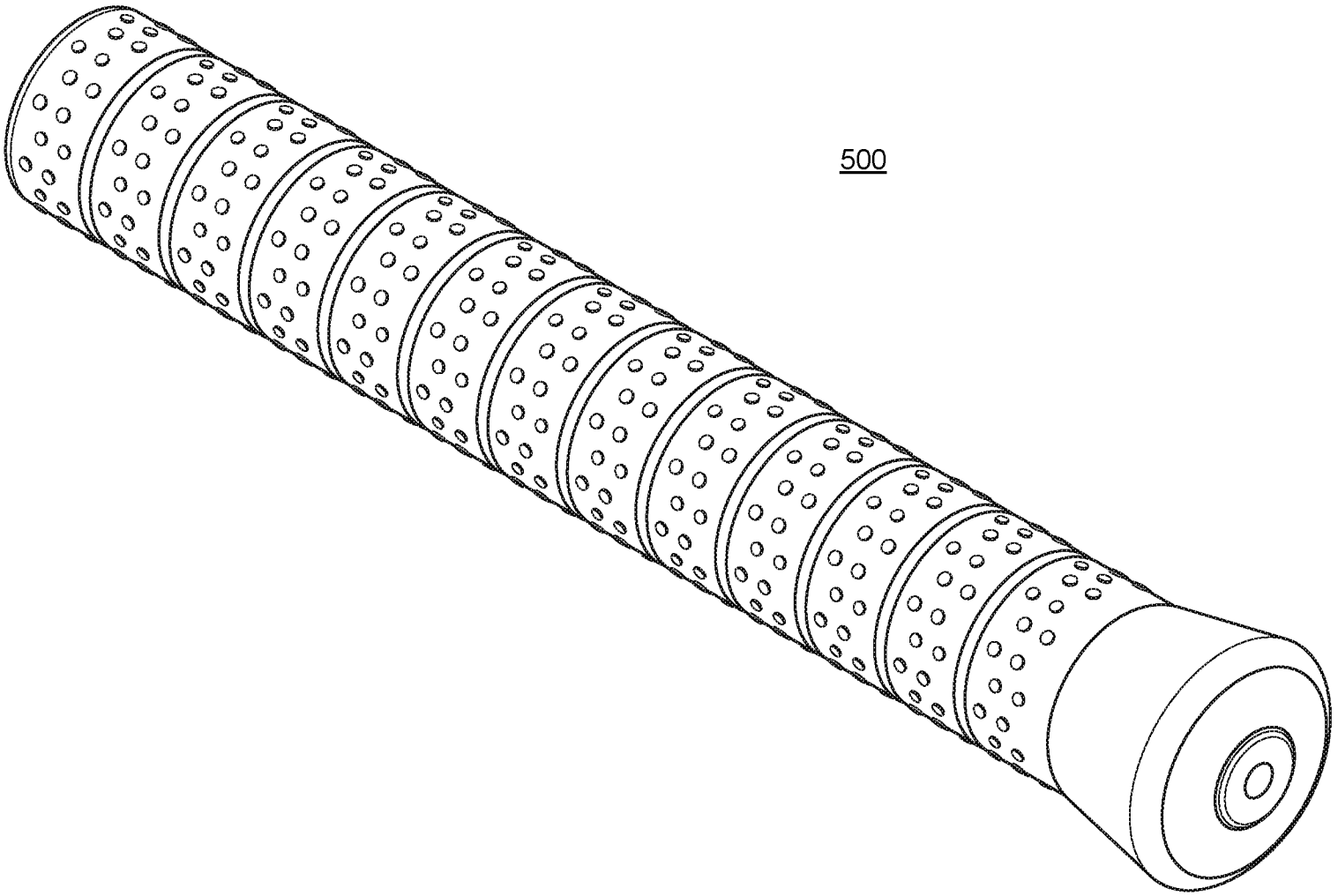
FIG. 6 shows a perspective view of the illustrative handle grip of FIG. 5A, in accordance with some embodiments of the present disclosure.

FIG. 5A shows a side view of illustrative handle grip 500, in accordance with some embodiments of the present disclosure. FIG. 5B shows a cross-sectional view of illustrative handle grip 500 of FIG. 5A, in accordance with some embodiments of the present disclosure. FIG. 6 shows a perspective view of illustrative handle grip 500 of FIG. 5A, in accordance with some embodiments of the present disclosure.

Handle grip 500, as illustratively shown in FIG. 5A, includes open end 518, grip section 516, transition section 514, and end section 512. Open end 518 is open to recess 519, which may be cylindrical, or nearly cylindrical, in shape. Wall thickness 510 of grip section 516 may be substantially constant along axis 550, or may optionally change along the length of grip section 516. As shown in FIGS. 5A, 5B, and 6, grip section 516 includes optional features 517 (e.g., small nodules as illustrated) to increase the effective friction and hand feel between grip section 516 and a user.

Grip section 516, as illustrated, includes thirteen grip rings arranged axially (e.g., one is shown by dimension 574), and twelve annular recesses (e.g., one is shown by dimension 573) arranged axially in between the grip rings. The annular recesses may aid in increasing friction between grip section 516 and a user (e.g., similar to features 517).

In some embodiments, handle grip 500 includes port 699, which may include a hole. In some embodiments, port 699 is used to aid in fitting handle grip 500 over the end of a bar. For example, by applying pressurized gas to port 699 to pressurize recess 519, grip section 516 may be made to stretch in the radial direction allowing installation.

Figure 5C:
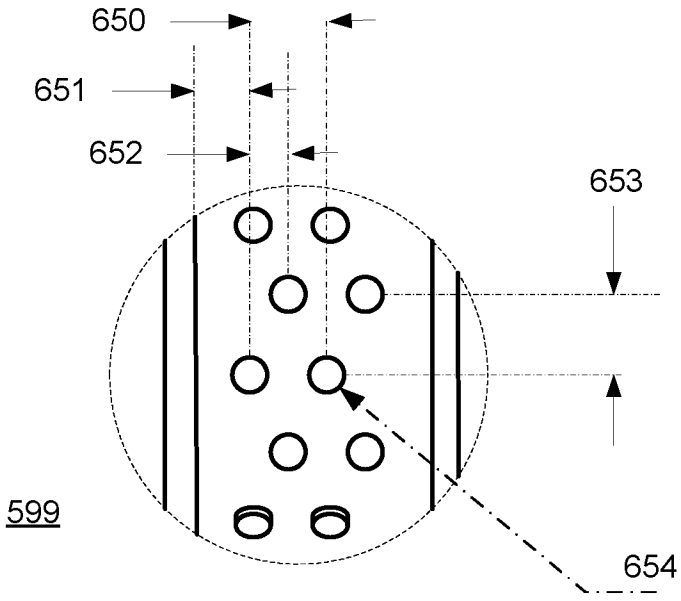
FIG. 5C shows an enlarged view of a portion of the illustrative handle grip of FIG. 5A, in accordance with some embodiments of the present disclosure.

FIG. 5C shows an enlarged view of a portion of illustrative handle grip 500 of FIG. 5A, taken from section 599, in accordance with some embodiments of the present disclosure. The enlarged view of FIG. 5C shows, for example, the nodules on the outer surface of grip section 516.

Illustrative handle grip 500 may include any suitable spatial dimensions. Table 1 includes illustrative ranges and examples of some spatial dimensions (in inches, unless otherwise indicated) included in FIGS. 5A, 5B and 5C. Note that the ranges included in Table 1 are prescribed for purposes of illustration, not limitation. Further, it will be understood that some spatial dimensions included in Table 1 may be conditional on the values of other spatial dimensions included in Table 1, and accordingly may have altered ranges based on this conditionality.

TABLE 1

Illustrative dimensions of handle grip 500.

| Feature No. | Illustrative Range of Values | Illustrative Example |
|---|---|---|
| 570 | 1.5-3 | 2.35 |
| 571 | 8-16 | 14.2 |
| 572 | 8-16 | 12.6 |
| 573 | 0.1-0.25 | 0.13 |
| 574 | 0.25-8 | 0.83 |

TABLE 1-continued

| Illustrative dimensions of handle grip 500. | | |
|---|---|---|
| Feature No. | Illustrative Range of Values | Illustrative Example |
| 575 | 0-1 | 0.10 |
| 600 | 0.05-0.25 | 0.13 |
| 601 | 1-2 | 1.60 |
| 602 | 0.5-1 | 0.83 |
| 603 | 0.5-1 | 0.95 |
| 604 | 0.5-1 | 0.63 |
| 605 | 1-2 | 1.25 |
| 610 | 150°-180° | 168.69° |
| 611 | 0.025-0.01 radius | 0.05 radius |
| 612 | 0.1-0.5 radius | 0.36 radius |
| 613 | 0.1-0.5 radius | 0.19 radius |
| 622 | 8-16 | 13.56 |
| 650 | 0.1-0.5 | 0.275 |
| 651 | 0.1-0.5 | 0.20 |
| 652 | 0.1-0.5 | 0.14 |
| 653 | 0.1-0.5 | 0.30 |
| 654 | 0.1-0.25 | 0.125 |

Figure 7B:
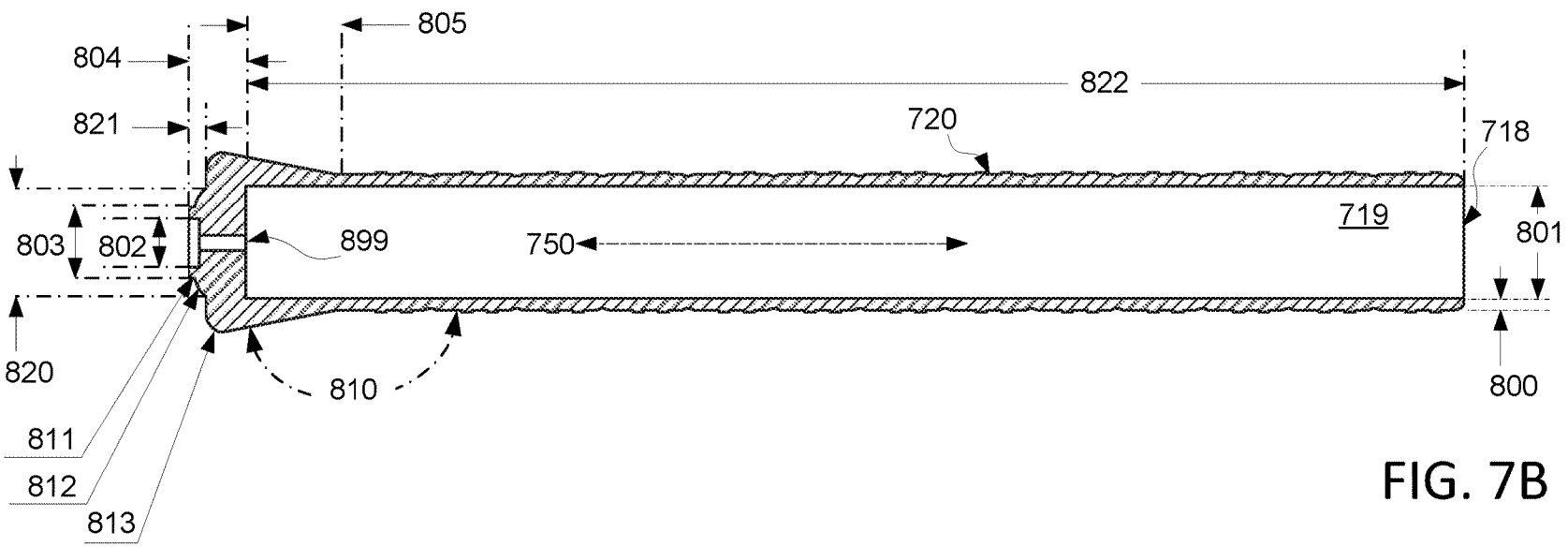
FIG. 7B shows a cross-sectional view of the illustrative handle grip of FIG. 7A, in accordance with some embodiments of the present disclosure.
Figure 7A:
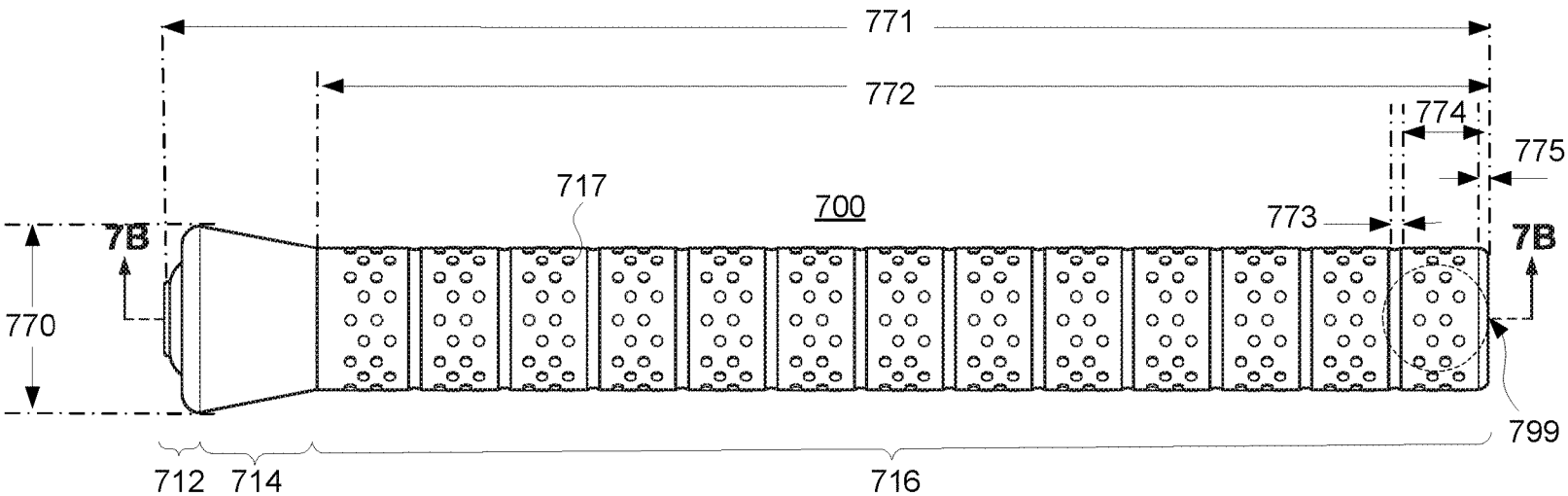
FIG. 7A shows a side view of an illustrative handle grip, in accordance with some embodiments of the present disclosure.
Figure 8:
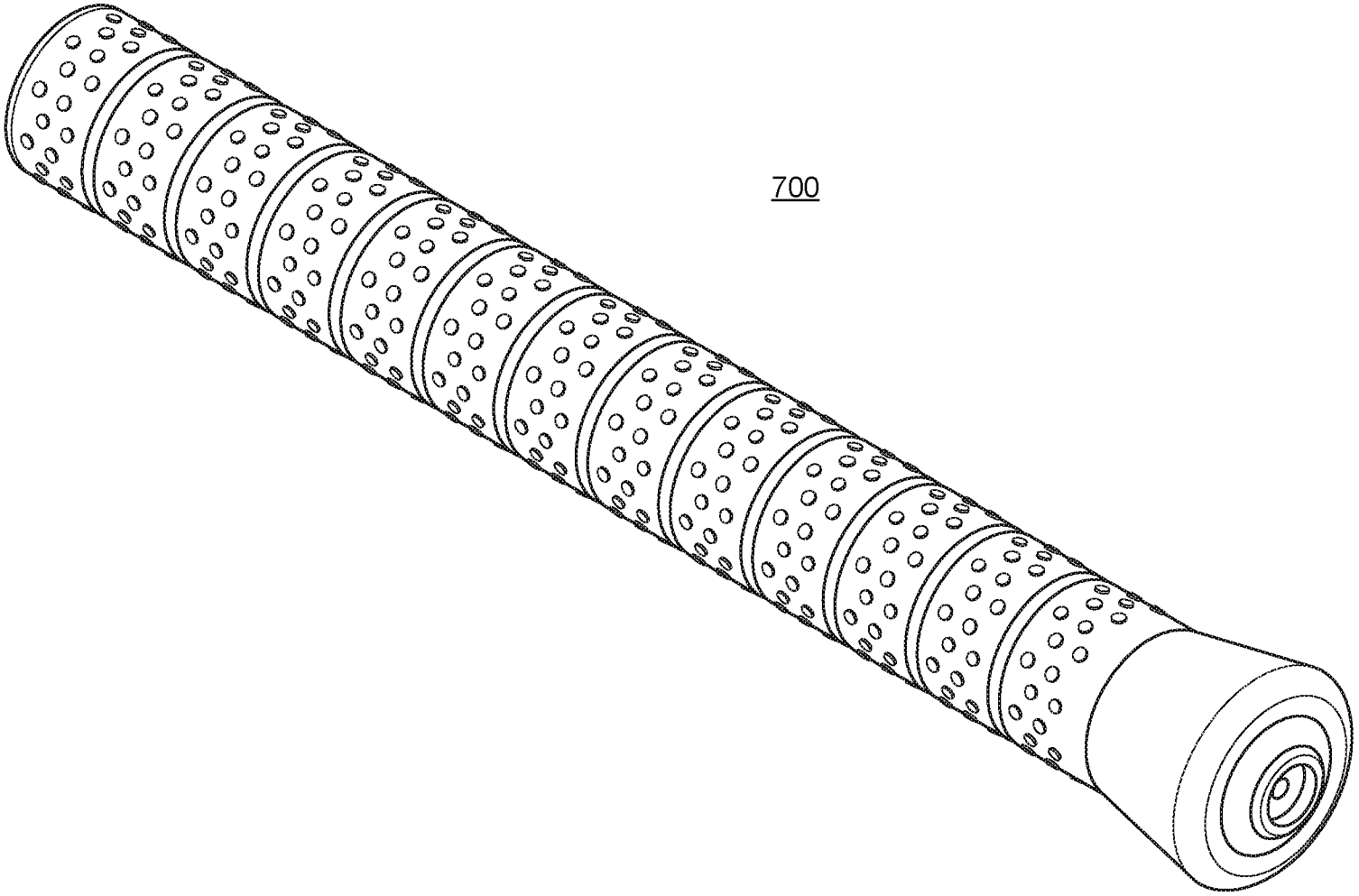
FIG. 8 shows a perspective view of the illustrative handle grip of FIG. 7A, in accordance with some embodiments of the present disclosure.

FIG. 7A shows a side view of illustrative handle grip 700, in accordance with some embodiments of the present disclosure. FIG. 7B shows a cross-sectional view of illustrative handle grip 700 of FIG. 7A, in accordance with some embodiments of the present disclosure. FIG. 8 shows a perspective view of illustrative handle grip 700 of FIG. 7A, in accordance with some embodiments of the present disclosure. Handle grip 700 exhibits some similarities to handle grip 500, although each may be designed for a particular application. For example, in some embodiments, handle grip 500 is configured to be used with a larger diameter bar than is handle grip 700.

Handle grip 700, as illustratively shown in FIG. 7A, includes open end 718, grip section 716, transition section 714, and end section 712. Open end 718 is open to recess 719, which may be cylindrical, or nearly cylindrical, in shape. Wall thickness 710 of grip section 716 may be substantially constant along axis 750, or may optionally change along the length of grip section 716. As shown in FIGS. 7A, 7B, and 8, grip section 716 includes optional features 717 (e.g., small nodules as illustrated) to increase the effective friction and hand feel between grip section 716 and a user.

Grip section 716, as illustrated, includes thirteen grip rings arranged axially (e.g., one is shown by dimension 774), and twelve annular recesses (e.g., one is shown by dimension 773) arranged axially in between the grip rings. The annular recesses may aid in increasing friction between grip section 716 and a user (e.g., similar to features 717).

In some embodiments, handle grip 700 includes port 899, which may include a hole. In some embodiments, port 899 is used to aid in fitting handle grip 700 over the end of a bar. For example, by applying pressurized gas to port 899 to pressurize recess 719, grip section 716 may be made to stretch in the radial direction allowing installation. As shown, an end of port 899 is located in a circular recess corresponding to dimension 802. It will be understood that in some embodiments, the circular recess corresponding to 802 may not be included and port 899 may continue to the left side of dimension 821.

Figure 7C:
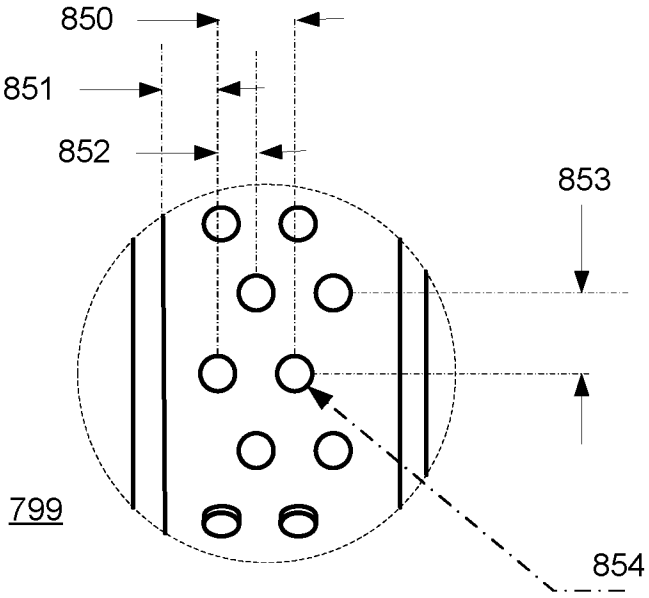
FIG. 7C shows an enlarged view of a portion of the illustrative handle grip of FIG. 7A, in accordance with some embodiments of the present disclosure.

FIG. 7C shows an enlarged view of a portion of the illustrative handle grip of FIG. 7A, taken from section 799, in accordance with some embodiments of the present disclosure. The enlarged view of FIG. 7C shows, for example, the nodules on the outer surface of grip section 716.

In an illustrative example, either or both of handle grips 500 and 700 may be used in any suitable exercise bar or fitness system. For example, handle grips 500 and 700 may be included as part of exercise bar 200 of FIG. 2 and exercise bar 300 of FIG. 3.

Illustrative handle grip 700 may include any suitable spatial dimensions. Table 2 includes illustrative ranges and examples of some spatial dimensions (in inches, unless otherwise indicated) included in FIGS. 7A, 7B, and 7C. Note that the ranges included in Table 2 are prescribed for purposes of illustration, not limitation. Further, it will be understood that some spatial dimensions included in Table 2 may be conditional on the values of other spatial dimensions included in Table 2, and accordingly may have altered ranged based on this conditionality.

TABLE 2

| Illustrative dimensions of handle grip 700. | | |
|---|---|---|
| Feature No. | Illustrative Range of Values | Illustrative Example |
| 770 | 1.5-3 | 2.00 |
| 771 | 8-16 | 14.1 |
| 772 | 8-16 | 12.5 |
| 773 | 0.1-0.25 | 0.13 |
| 774 | 0.25-8 | 0.83 |
| 775 | 0-1 | 0.10 |
| 800 | 0.05-0.25 | 0.120 |
| 801 | 1-2 | 1.2598 |
| 802 | 0.1-1 | 0.56 |
| 803 | 0.5-2 | 0.83 |
| 804 | 0.5-1 | 0.625 |
| 805 | 1-2 | 1.44 |
| 810 | 150°-180° | 169° |
| 811 | 0.025-0.01 radius | 0.05 radius |
| 812 | 0.1-0.5 radius | 0.36 radius |
| 813 | 0.1-0.5 radius | 0.19 radius |
| 820 | 1-3 | 1.25 |
| 821 | 0.1-0.5 | 0.13 |
| 822 | 8-16 | 13.5 |
| 850 | 0.1-0.5 | 0.275 |
| 851 | 0.1-0.5 | 0.20 |
| 852 | 0.1-0.5 | 0.14 |
| 853 | 0.1-0.5 | 0.25 |
| 854 | 0.1-0.25 | 0.125 |

As illustrated in FIGS. 5A, 5B, 6, 7A, 7B, and 8, the end sections of a handle grip may include useful geometric features, in accordance with some embodiments of the present disclosure. For example, contoured end sections 512 and 712 include multiple radii of curvature, rather than a flat surface. This contoured end face may aid in maintaining contact of sufficient area with a reference surface (e.g., a floor). For example, if end section 512 were flat, and the exercise bar were held off-axis against the floor (e.g., at an angle less than 90° to the floor), the contact area would be relatively small (e.g., just at the circular corner). This may lead to damage from high contact pressures, or increased susceptibility to slippage (e.g., as the surface area is reduced). By including radii of curvature, end sections 512 and 712 are able to maintain contact with a reference surface over a sufficient area, at a plurality of contact angles. Further, by contouring end sections 512 and 712, the use of a single material for handle grips 500 and 700 may achieve desired results.

Figure 9:
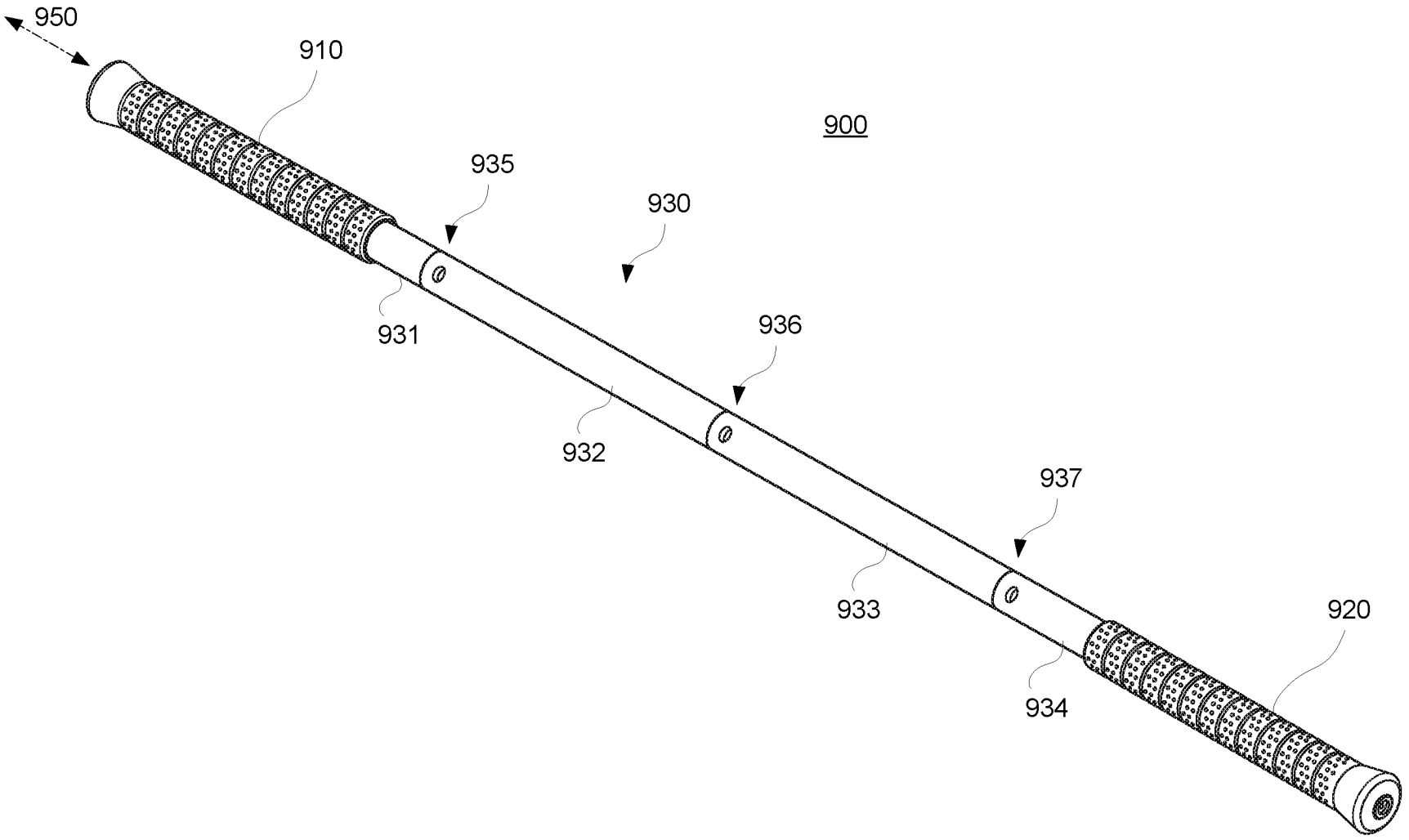
FIG. 9 shows a perspective view of an illustrative exercise bar, having a segmented bar, in accordance with some embodiments of the present disclosure.
Figure 10:
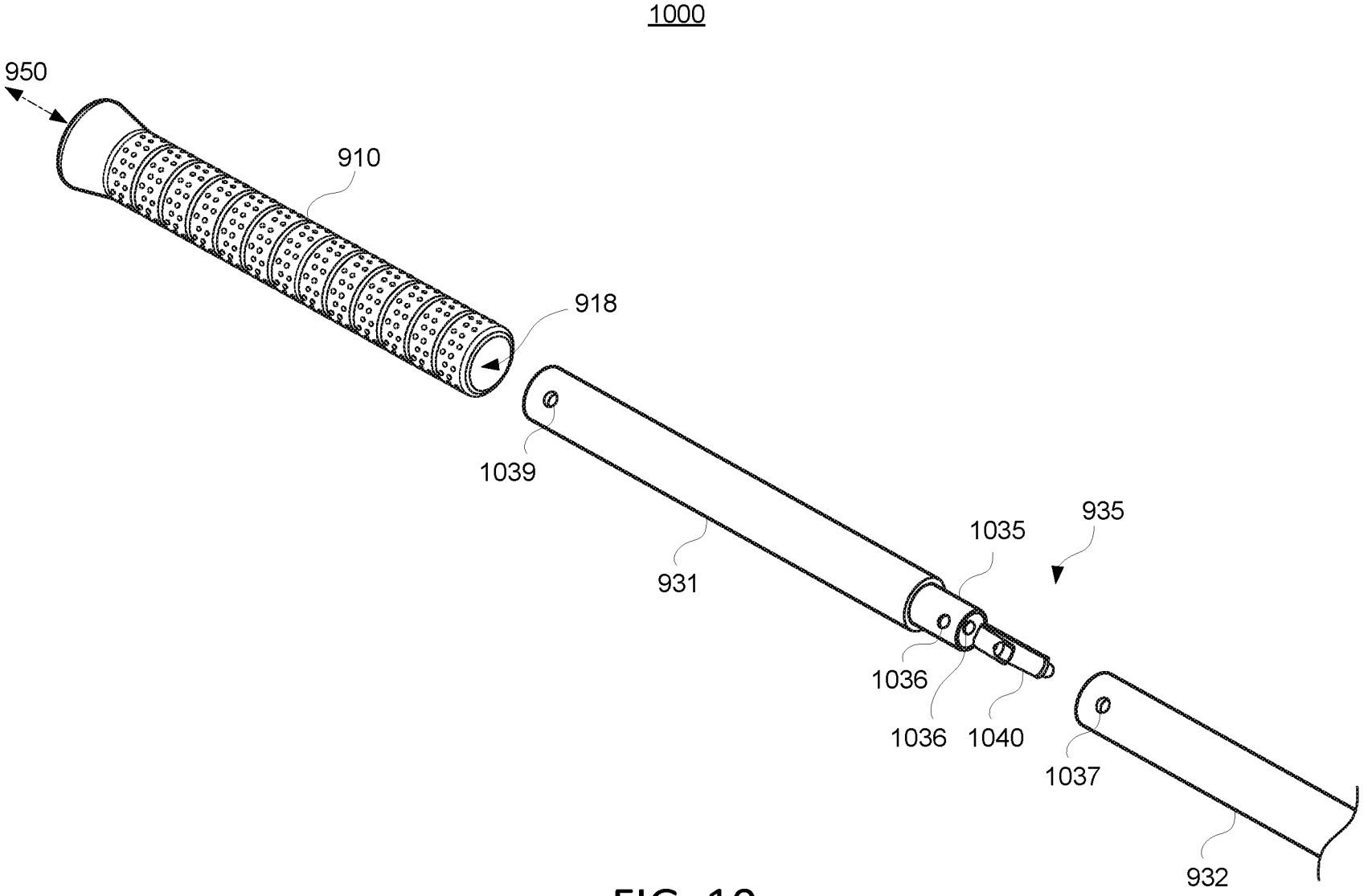
FIG. 10 shows an exploded view of a portion of the illustrative exercise bar of FIG. 9, in accordance with some embodiments of the present disclosure.

FIG. 9 shows a perspective view of illustrative fitness system 900, having a segmented bar 930, in accordance with some embodiments of the present disclosure. As illustratively shown in FIG. 9, segmented bar 930 includes segments 931, 932, 933, and 934 arranged axially along axis 950. Fitness system 900 includes handle grips 910 and 920, arranged at respective ends of segmented bar 930. Handle grips 910 and 920 may be similar to any of the handle grips described in the context of FIGS. 2-8. FIG. 10 shows an exploded view of a portion of illustrative fitness system 900 of FIG. 9, in accordance with some embodiments of the present disclosure. It will be understood that FIGS. 9-10 are merely illustrative, and that any suitable number of segments (e.g., two or more), identical to each other or otherwise, may be included in a fitness system, in accordance with the present disclosure.

Segments 931, 932, 933, and 934 are arranged with interfaces 935, 936, and 937. More particularly, as shown in FIG. 9, segments 931 and 932 meet at interface 935, segments 932 and 933 meet at interface 936, and segments 933 and 934 meet at interface 937. Handle grip 910 is engaged to segment 931 (e.g., at a first end of bar 930), and handle grip 920 is engage to segment 934 (e.g., at a second end of bar 930). In some embodiments, segments 931, 932, 933, and 934 are identical to one another. For example, segments 931, 932, 933, and 934 may each have the same length as each other. In an illustrative example, bar 930 may be six feet long, and each of segments 931, 932, 933, and 934 may be one-and-a-half feet long. In a further illustrative example (not shown), a bar may be six feet long and include three segments, each being two feet long. Accordingly, a fitness system may be disassembled to reduce a spatial dimension (e.g., packed in a carry-on bag for airline travel). In some embodiments, segments 931, 932, 933, and 934 need not be identical to one another.

As shown in the exploded view of FIG. 10, segments 931 and 932, for example, engage each other via coupler 1035. As shown illustratively in FIG. 10, coupler 1035 is configured to fit radially inside of segments 931 and 932, and axially overlap at least a portion of segments 931 and 932. In some embodiments, a coupled may be configured to fit radially outside of segments 931 and 932, or portions thereof (not shown). Coupler 1035 includes holes 1036 configured to line up with holes 1037 of segment 932. Locking mechanism 1040, as shown in FIG. 10, includes two pins configured to pass through holes 1036 and 1037, thus constraining relative axial motion of segments 931 and 932. Any suitable locking mechanism may be used such as, for example, a pin, a latch, a threaded fastener, an adhesive, mating threads, a twist lock interface, any other suitable interface, or any combination thereof, in accordance with the present disclosure. As shown illustratively in FIGS. 9-10, segments 931 and 932 are identical to each other, although holes 1039 are not used to engage with another segment. In some embodiments, holes 1039 are not included.

Coupler 1035 may include any suitable spatial dimensions, material properties, and features, in accordance with the present disclosure. For example, coupler 1035 may be as long as segment 931 axially so that when connected, bar 930 has similar bending resistance along the length. In a further example, coupler 1035 may include a sufficient radial thickness, material strength, or both to add stiffness to bar 930 at interface 935. In a further example, segment 931 may have a relatively small thickness at the ends (e.g., thinner than the middle portion) such that coupler 1035, when inserted, causes the overall bar to have the same inner diameter (e.g., segment 931 may include a recess into which coupler 1035 fits). In some embodiments, each coupler is adhered (e.g., using epoxy) to its respective segment. In some embodiments, an additional element (e.g., an elastomer ring) may be used between the axial ends of each segment to reduce joint stress.

Under normal operation (e.g., when being used for exercise), locking mechanism 1040 remains in holes 1036 and 1037. When segments 931 and 932 are separated, for example, locking mechanism may remain in holes 1036. Locking mechanism 1040 is manually operated to connect and disconnect segments 931 and 932. In some embodiments, locking mechanism 1040 may be integrated into, or otherwise be not removable from, coupler 1035.

In some embodiments, a bar and two handle grips are assembled to form an exercise bar. In some embodiments, the bar may be fabricated and the handle grips may be fabricated separately. For example, the bar may be cut to size, formed from smaller segments, or otherwise fabricated to have a desired length. In a further example, the handle grips may be formed by injection molding a suitable material in a suitable injection molding die.

In some embodiments, the bar is segmented, and accordingly includes more than one segment which may be assembled to form the bar. For example, in some embodiments, the bar includes two, three, four, five or more segments.

Assembly may include, for example, sliding the handle grips over respective ends of the bar. In some embodiments, the inner diameter of the grip portion of the handle grip in the unassembled state may be slightly smaller than the outer diameter of the bar, or the ends of the bar (e.g., an interference fit).

In some embodiments, the handle grips are pushed onto the bar with suitable force to stretch over the bar. Accordingly, when assembled, the handle grips impart a compressive force onto the bar (e.g., applied in the radially inward direction to the outer radial surface of the bar in contact with the handle grip. The interference fit may extend the entire axially length of the grip portion, or a section thereof.

In some embodiments, the handle grips are pushed onto the bar with the aid of gas pressure to stretch over the bar. For example, this technique may be used when the force is relatively large, or if the process is automated. The handle grip may include, for example, a port to which pressurized gas may be applied. Application of the pressurized gas may radially expand the handle grip sufficiently that the inner diameter of the grip section fits over the bar, allowing assembly. When assembled, the gas pressure is removed, and accordingly, the handle grips impart a compressive force onto the bar (e.g., applied in the radially inward direction to the outer radial surface of the bar in contact with the handle grip.

Design Aspects

The following disclosure describes two illustrative designs of a handle grip, in accordance with the present disclosure. In some embodiments, FIGS. 11-15 illustrate the ornamental design of a first handle grip as shown and described. In some embodiments, FIGS. 16-20 illustrate the ornamental design of a second handle grip as shown and described.

In some embodiments, the present disclosure is directed to a new, original, and ornamental design for a first HANDLE GRIP, of which the following is a specification, reference being had to the accompanying drawings (i.e., FIGS. 11-15), forming a part thereof. The first handle grip may, for example, be a handle grip for the end of a bar to be used as a fitness system. Applicant reserves the right to claim any part, portion, element, and/or combination thereof of the disclosed design, including to replace any solid line with a broken line to disclaim any part, portion, element, and/or combination thereof of the disclosed design. The dot-dashed broken lines in FIGS. 11-15 depict a boundary; the dot-dash line itself and the area within form no part of the claimed design.

Figure 11:
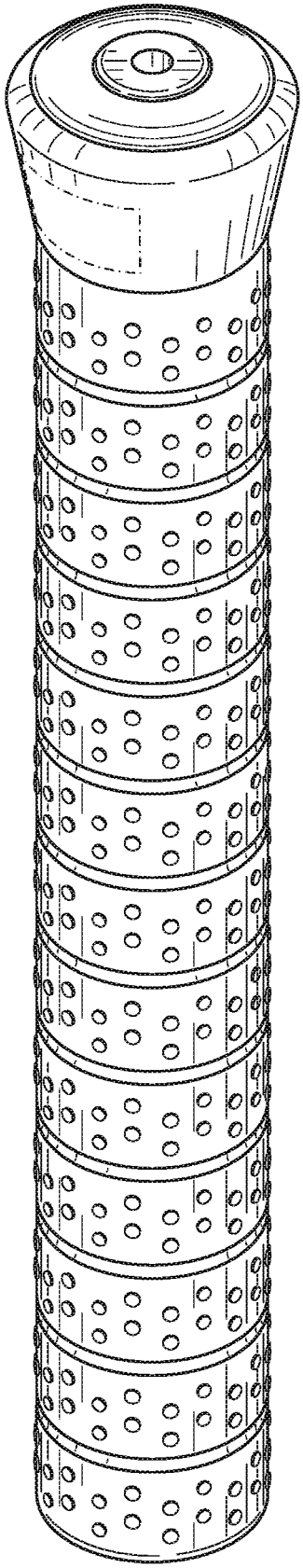
FIG. 11 is a front perspective view of a first handle grip.
Figure 12:
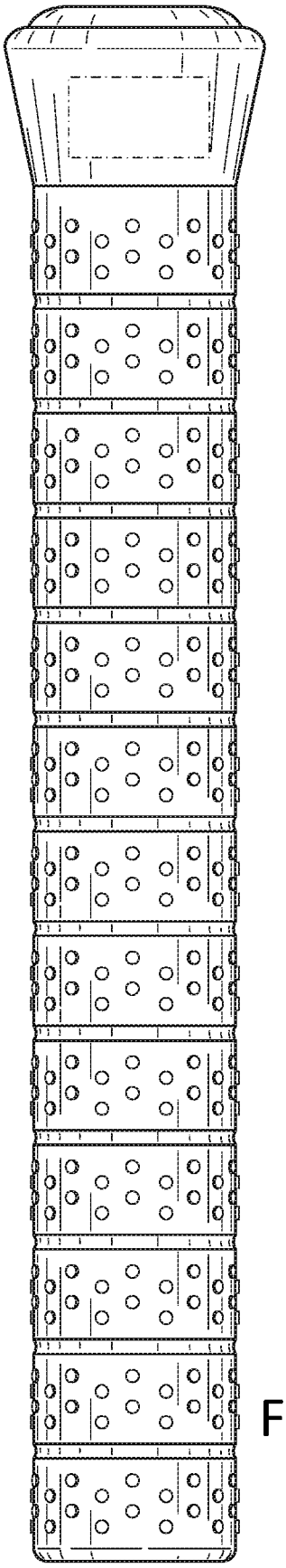
FIG. 12 is a front view of the first handle grip (both the front and back views being identical)
Figure 13:
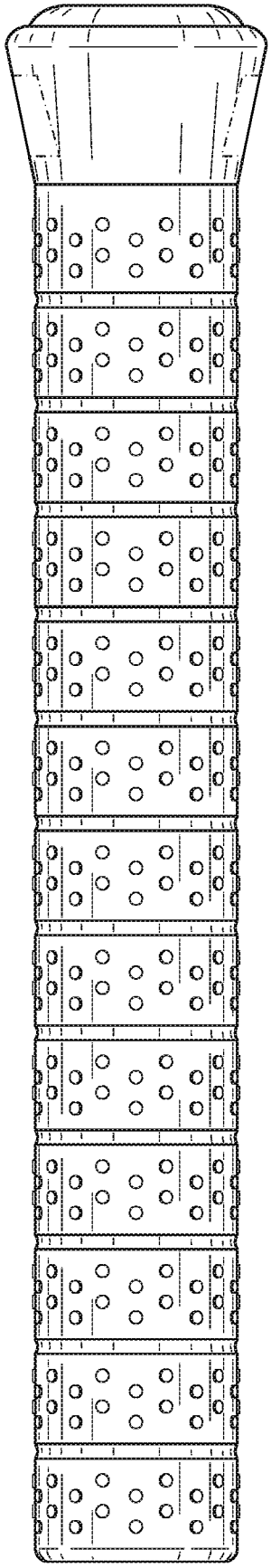
FIG. 13 is a right-side view of the handle grip (both the right and left side views being identical)

FIG. 11 is a front perspective view of a first handle grip;

FIG. 12 is a front view of the first handle grip (both the front and back views being identical);

FIG. 13 is a right-side view of the handle grip (both the right and left side views being identical).

Figure 14:
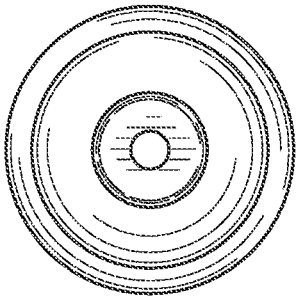
FIG. 14 is a top view of the first handle grip (nearest the closed end)

FIG. 14 is a top view of the first handle grip (nearest the closed end).

Figure 15:
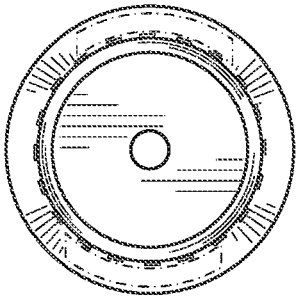
FIG. 15 is a bottom view of the first handle grip (nearest the open end)

FIG. 15 is a bottom view of the first handle grip (nearest the open end).

In some embodiments, the present disclosure is directed to a new, original, and ornamental design for a second HANDLE GRIP, of which the following is a specification, reference being had to the accompanying drawings (i.e., FIGS. 16-20), forming a part thereof. The second handle grip may, for example, be a handle grip for the end of a bar to be used as a fitness system. Applicant reserves the right to claim any part, portion, element, and/or combination thereof of the disclosed design, including to replace any solid line with a broken line to disclaim any part, portion, element, and/or combination thereof of the disclosed design, or to replace any broken line with a solid line to claim any part, portion, element, and/or combination thereof of the disclosed design. The dashed broken lines in FIGS. 16-20 depict portions of the second handle grip that are optional aspects of the design.

Figure 16:
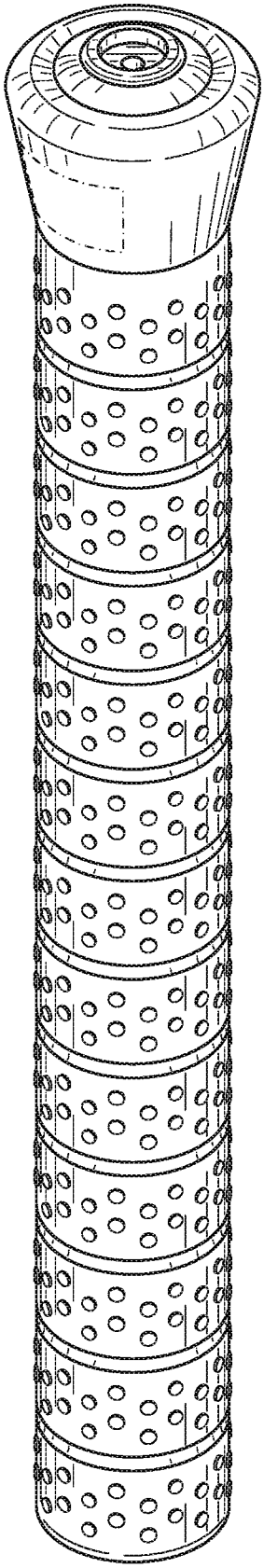
FIG. 16 is a front perspective view of a second handle grip.

FIG. 16 is a front perspective view of a second handle grip.

Figure 17:
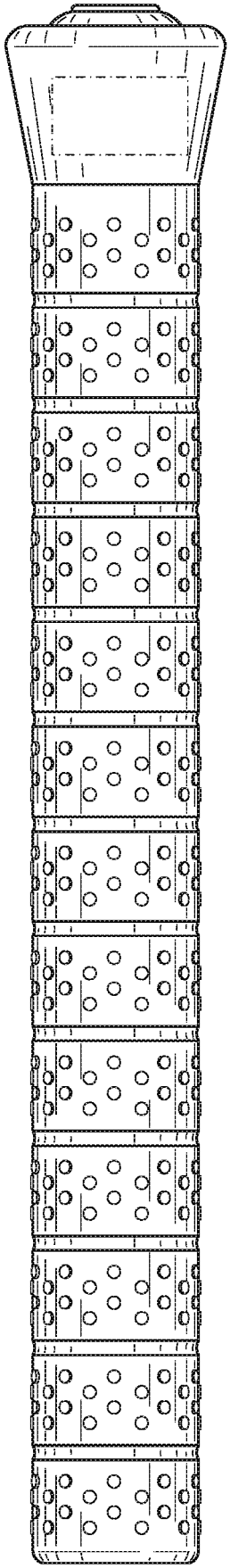
FIG. 17 is a front view of the second handle grip (both the front and back views being identical)

FIG. 17 is a front view of the second handle grip (both the front and back views being identical).

Figure 18:
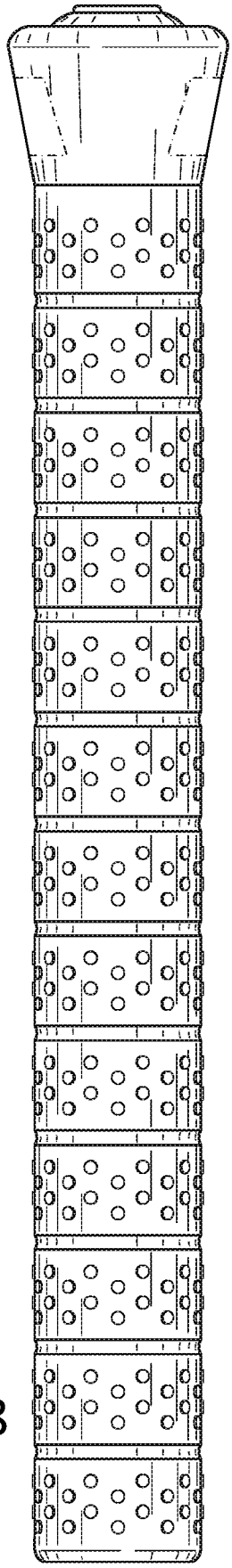
FIG. 18 is a right-side view of the second handle grip (both the right and left side views being identical)

FIG. 18 is a right-side view of the second handle grip (both the right and left side views being identical).

Figure 19:
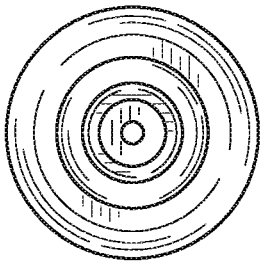
FIG. 19 is a top view of the second handle grip (nearest the closed end)

FIG. 19 is a top view of the second handle grip (nearest the closed end).

Figure 20:
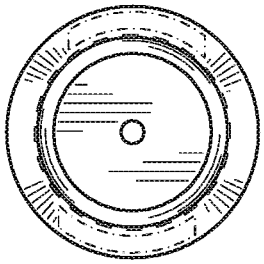
FIG. 20 is a bottom view of the second handle grip (nearest the open end).

FIG. 20 is a bottom view of the second handle grip (nearest the open end).

The foregoing is merely illustrative of the principles of this disclosure and various modifications may be made by those skilled in the art without departing from the scope of this disclosure. The above described embodiments are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the spirit of the following claims.

What is claimed is:

1. A tubular handle grip configured to interface to an end of a cylindrical bar, the handle grip comprising:

a grip section at least 8 inches in axial length and having a wall thickness;

an open end arranged at one end of the grip section and configured to fit over the end of the cylindrical bar; and a closed end coupled to the grip section and arranged axially opposite to the open end, wherein the closed end is configured to react to axial and lateral loads from a user, wherein:

the closed end is coupled to the grip section by a transition section comprising a varying wall thickness that increases from the grip section to the closed end, the closed end comprises a first contoured end section extending from the transition section in a direction axially away from the open end and a second contoured end section extending from the first contoured end section in the direction axially away from the open end, the first contoured end section, when viewed in a cross-sectional view taken through the axis of the handle grip, comprises a first convex exterior curved surface whose radius from the axis of the handle grip decreases as the first contoured end section extends away from the transition section in the direction axially away from the open end, the second contoured end section, when viewed in the cross-sectional view taken through the axis of the handle grip, comprises a second convex exterior curved surface whose radius from the axis of the handle grip decreases as the second contoured end section extends away from the transition section in the direction axially away from the open end, the first convex exterior curved surface forms a first annular raised surface and the second convex exterior curved surface forms a second annular raised surface, and an annular depression resides between the first annular raised surface and the second annular raised surface.

2. The tubular handle grip of claim 1, wherein the closed end comprises a thickness greater than the wall thickness.

3. The tubular handle grip of claim 1, wherein the tubular handle grip is substantially axisymmetric about a center axis.

4. The tubular handle grip of claim 1, wherein the open end is open to a cylindrical recess extending axially inside of the grip section, and wherein the cylindrical recess is configured to engage with the end of the cylindrical bar.

5. The tubular handle grip of claim 4, wherein the cylindrical recess is at least 12 inches long.

6. The tubular handle grip of claim 4, wherein the cylindrical recess is configured to engage with the end of the cylindrical bar by a friction force.

7. The tubular handle grip of claim 6, wherein the grip section is in tension azimuthally, and the tension causes the friction force.

8. The tubular handle grip of claim 1, wherein:

the grip section comprises an outer surface, the outer surface comprises a plurality of grip rings arranged axially along the grip section, adjacent ones of the plurality of grip rings being separated from each other by an annular recess, and each of the plurality of grip rings comprise a plurality of raised features configured to increase the effective friction between the outer surface and the user.

9. The tubular handle grip of claim 1, wherein the grip section comprises an outer diameter of at least 1.5 inches.

10. The tubular handle grip of claim 1, wherein the tubular handle grip is at least 12 inches long.

11. The tubular handle grip of claim 1, wherein the closed end has a maximum diameter of at least 2 inches.

12. A fitness system comprising:

a bar comprising two ends; and a pair of handle grips, each arranged at a respective end of the bar, wherein each handle grip comprises:

a grip section at least 8 inches in axial length and having a wall thickness;

an open end arranged at one end of the grip section and configured to slide over a respective end of the bar; and a closed end coupled to the grip section and arranged axially opposite to the open end, wherein the closed end is configured to react to axial and lateral loads from a user, and wherein:

the closed end is coupled to the grip section by a transition section comprising a varying wall thickness that increases from the grip section to the closed end, the closed end comprises a first contoured end section extending from the transition section in a direction axially away from the open end and a second contoured end section extending from the first contoured end section in the direction axially away from the open end, the first contoured end section, when viewed in a cross-sectional view taken through the axis of the handle grip, comprises a first convex exterior curved surface whose radius from the axis of the handle grip decreases as the first contoured end section extends away from the transition section in the direction axially away from the open end, the second contoured end section, when viewed in the cross-sectional view taken through the axis of the handle grip, comprises a second convex exterior curved surface whose radius from the axis of the handle grip decreases as the second contoured end section extends away from the transition section in the direction axially away from the open end, the first convex exterior curved surface forms a first annular raised surface and the second convex exterior curved surface forms a second annular raised surface, and an annular depression resides between the first annular raised surface and the second annular raised surface.

13. The fitness system of claim 12, wherein the bar comprises at least two segments configured to engage axially to form the bar comprising the two ends.

14. The fitness system of claim 13, wherein each segment engages with another segment at a respective interface, the fitness system further comprising a respective coupler arranged at each respective interface and configured to aid in engaging the corresponding segments.

15. The fitness system of claim 14, further comprising a respective locking mechanism corresponding to each respective interface, wherein the locking mechanism is configured to constrain a relative motion of the corresponding segments.

16. A fitness system comprising:

a bar comprising at least two segments configured to engage axially to form the bar, wherein each segment has an outer diameter, wherein the outer diameters of the at least two segments are the same, and wherein the bar comprises two ends; and a pair of handle grips arranged at each end of the bar and configured to react to axial and lateral loads from a user, wherein each handle grip comprises:

a grip section at least 8 inches in axial length and having a wall thickness;

an open end arranged at one end of the grip section and configured to fit over the end of the cylindrical bar; and a closed end coupled to the grip section and arranged axially opposite to the open end, wherein the closed end is configured to react to axial and lateral loads from a user, wherein:

the closed end is coupled to the grip section by a transition section comprising a varying wall thickness that increases from the grip section to the closed end, the closed end comprises a first contoured end section extending from the transition section in a direction axially away from the open end and a second contoured end section extending from the first contoured end section in the direction axially away from the open end, the first contoured end section, when viewed in a cross-sectional view taken through the axis of the handle grip, comprises a first convex exterior curved surface whose radius from the axis of the handle grip decreases as the first contoured end section extends away from the transition section in the direction axially away from the open end, the second contoured end section, when viewed in the cross-sectional view taken through the axis of the handle grip, comprises a second convex exterior curved surface whose radius from the axis of the handle grip decreases as the second contoured end section extends away from the transition section in the direction axially away from the open end, and the closed end comprises a port centered in the second contoured end section, the port comprising a through-hole extending axially through the closed end.

17. The fitness system of claim 16, wherein each segment engages with another segment at a respective interface, the fitness system further comprising a respective coupler arranged at each respective interface and configured to aid in engaging the corresponding segments.

18. The fitness system of claim 17, further comprising a respective locking mechanism corresponding to each respective interface, wherein the locking mechanism is configured to constrain a relative motion of the corresponding segments.

19. The fitness system of claim 16, wherein each segment has a length of two feet or less.

20. A tubular handle grip configured to interface to an end of a cylindrical bar, the handle grip comprising:

a grip section at least 8 inches in axial length and having a wall thickness;

an open end arranged at one end of the grip section and configured to fit over the end of the cylindrical bar; and a closed end coupled to the grip section and arranged axially opposite to the open end, wherein the closed end is configured to react to axial and lateral loads from a user, wherein:

the closed end is coupled to the grip section by a transition section comprising a varying wall thickness that increases from the grip section to the closed end, the closed end comprises a first contoured end section extending from the transition section in a direction axially away from the open end and a second contoured end section extending from the first contoured end section in the direction axially away from the open end, the first contoured end section, when viewed in a cross-sectional view taken through the axis of the handle grip, comprises a first convex exterior curved surface whose radius from the axis of the handle grip decreases as the first contoured end section extends away from the transition section in the direction axially away from the open end, the second contoured end section, when viewed in the cross-sectional view taken through the axis of the handle grip, comprises a second convex exterior curved surface whose radius from the axis of the handle grip decreases as the second contoured end section extends away from the transition section in the direction axially away from the open end, and the closed end comprises a port centered in the second contoured end section, the port comprising a through-hole extending axially through the closed end.

21. The tubular handle grip of claim 20, wherein the open end is open to a cylindrical recess extending axially inside of the grip section, and wherein the cylindrical recess is configured to engage with the end of the cylindrical bar.

* * * * *